US007595584B2

(12) United States Patent
Hwang

(10) Patent No.: US 7,595,584 B2
(45) Date of Patent: Sep. 29, 2009

(54) ELECTRON EMISSION DEVICE AND ELECTRON EMISSION DISPLAY USING THE SAME

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 390 days.

(21) Appl. No.: 11/585,763

(22) Filed: Oct. 23, 2006

(65) Prior Publication Data

US 2007/0090746 A1 Apr. 26, 2007

(30) Foreign Application Priority Data

Oct. 25, 2005 (KR) ..... 10-2005-0100665

(51) Int. Cl.
*H01J 63/04* (2006.01)

(52) U.S. Cl. ..... 313/495; 313/306

(58) Field of Classification Search ..... 313/495–497, 313/306

See application file for complete search history.

(56) References Cited

U.S. PATENT DOCUMENTS 5,955,850 A * 9/1999 Yamaguchi et al. ..... 313/495
2004/0227453 A1* 11/2004 Ando et al. ..... 313/495
2005/0116612 A1* 6/2005 Oh ..... 313/497
2005/0184647 A1 8/2005 Chang
2005/0264170 A1 12/2005 Oh

FOREIGN PATENT DOCUMENTS

CN 1622271 A1 6/2005
EP 1 542 258 A2 6/2005
WO WO 00/24027 4/2000

OTHER PUBLICATIONS

European Search Report dated Apr. 10, 2007, for EP 06122499.4, in the name of Samsung SDI Co., Ltd.

* cited by examiner

*Primary Examiner*—Toan Ton
*Assistant Examiner*—Hana A Sanei
(74) *Attorney, Agent, or Firm*—Christie, Parker & Hale, LLP

(57) ABSTRACT

An electron emission device includes a substrate; cathode electrodes formed on the substrate; electron emission regions electrically connected to the cathode electrodes; and gate electrodes positioned with the cathode electrodes with an insulating layer interposed between the cathode electrodes and the gate electrodes, the gate electrodes crossing the first electrodes to form a plurality of crossed regions. Here, at least two rows of the electron emission regions are placed at respective crossed regions along a longitudinal direction of the cathode electrodes, and the electron emission regions at the respective rows are deviated from each other in a longitudinal direction of the gate electrodes. In addition, the insulating layer and the gate electrodes have opening portions corresponding to the respective electron emission regions to expose the electron emission regions.

12 Claims, 4 Drawing Sheets

ELECTRON EMISSION DEVICE AND ELECTRON EMISSION DISPLAY USING THE SAME

CROSS-REFERENCE TO RELATED APPLICATION

This application claims priority to and the benefit of Korean Patent Application No. 10-2005-0100665, filed on Oct. 25, 2005, in the Korean Intellectual Property Office, the entire content of which is incorporated herein by reference.

BACKGROUND OF THE INVENTION

1. Field of the Invention

The present invention relates to an electron emission device and an electron emission display using the electron emission device, and in particular, to an electron emission device that improves an arrangement of electron emission regions and gate electrode opening portions for respective unit pixels, thereby increasing the electron emission efficiency.

2. Description of Related Art

In general, an electron emission element can be classified, depending upon the kinds of electron sources, into a hot cathode type or a cold cathode type.

Among the cold cathode type of electron emission elements, there are a field emitter array (FEA) type, a surface conduction emission (SCE) type, a metal-insulator-metal (MIM) type, and a metal-insulator-semiconductor (MIS) type.

The FEA type of electron emission element includes electron emission regions, and cathode and gate electrodes that are used as the driving electrodes for controlling the emission of electrons from the electron emission regions. The electron emission regions are formed with a material having a low work function and/or a high aspect ratio. For instance, the electron emission regions are formed with a carbonaceous material such as carbon nanotubes (CNT), graphite, and diamond-like carbon (DLC). With the usage of such a material for the electron emission regions, when an electric field is applied to the electron emission regions under a vacuum atmosphere (or vacuum state), electrons are easily emitted from these electron emission regions.

Arrays of the electron emission elements are arranged on a first substrate to form an electron emission device. A light emission unit is formed on a second substrate with phosphor layers and an anode electrode, which is assembled with the first substrate, thereby forming an electron emission display.

That is, the electron emission device includes the electron emission regions, and the plurality of driving electrodes functioning as the scan and data electrodes, which are operated to control the on/off and amount of electron emission for the respective unit pixels. With the electron emission display, the electrons emitted from the electron emission regions excite the phosphor layers, thereby emitting light or displaying the desired images.

With the typical FEA type of electron emission device, cathode electrodes, an insulating layer, and gate electrodes are sequentially formed on a substrate, and opening portions are formed at the gate electrode and the insulating layer to partially expose a surface of the cathode electrode. Electron emission regions are formed on the cathode electrode internal to the opening portion. Also, it is typical to serially arrange the electron emission regions along the longitudinal direction of the cathode electrodes for the respective unit pixels (or pixel units).

With the above structure, as the number of electron emission regions for the respective unit pixels is increased, the electron emission uniformity is enhanced, and the driving voltage is lowered. However, with the structure where the opening portions of the insulating layer and the gate electrode surround the respective electron emission regions, it is considerably more difficult in process (or manufacturing process) to increase the number of electron emission regions because the size of gate electrode opening portions needs to be reduced and/or the distance between the electron emission regions needs to be shortened.

Furthermore, with the above-structured electron emission device, electron fields are formed around the electron emission regions due to the voltage difference between the cathode and gate electrodes, and electrons are emitted from the electron emission regions due to the electric fields. As the electron emission regions and the gate electrodes are spaced apart from each other along a direction (or surface direction) of the first substrate, some electrons are emitted from the electron emission regions with a slant (or in a slanted manner), and are spread (or diffused) toward a counter substrate.

Consequently, the electrons collide with the phosphor layers at the relevant pixels as well as on the phosphor layers at other pixels neighboring thereto, thereby inducing incorrect color light emission and deteriorating the display quality. As such, there is a need to develop a structure that reduces or prevents the spreading of electron beams.

SUMMARY OF THE INVENTION

It is an aspect of the present invention to provide an improved electron emission device that increases a uniformity in electron emission, lowers a driving voltage, and reduces or prevents a spreading of electron beams to thereby reduce incorrect color light emissions.

It is another aspect of the present invention to provide an electron emission display that uses the improved electron emission device.

According to an embodiment of the present invention, an electron emission device includes a substrate; a plurality of first electrodes formed on the substrate; a plurality of electron emission regions electrically connected to the first electrodes; and a plurality of second electrodes positioned with the first electrodes with an insulating layer interposed between the first electrodes and the second electrodes, the second electrodes crossing the first electrodes to form a plurality of crossed regions. Here, at least two rows of the electron emission regions are placed at respective crossed regions along a longitudinal direction of the first electrodes, and the electron emission regions at the respective rows are deviated from each other in a longitudinal direction of the second electrodes. In addition, the insulating layer and the second electrodes have a plurality of opening portions corresponding to the respective electron emission regions to expose the electron emission regions.

In one embodiment, one of the electron emission regions of one of the at least two rows of the electron emission regions is positioned to correspond to the center between two of the electron emission regions of another one of the at least two rows of the electron emission regions.

In one embodiment, the at least two rows of the electron emission regions are arranged for the respective crossed regions in a zigzag shape.

In one embodiment, the electron emission regions include at least one material selected from the group consisting of carbon nanotubes, graphite, graphite nanofiber, diamond, diamond-like carbon, $C_{60}$, silicon nanowire, and combinations thereof.

In one embodiment, the electron emission device further includes a focusing electrode placed over the second electrodes by interposing an additional insulating layer between the second electrodes and the focusing electrode, wherein the additional insulating layer and the focusing electrode have an opening portion formed at each of the crossed regions to expose the opening portions of the second electrodes at each of the crossed regions.

In one embodiment, the at least two rows of the electron emission regions are arranged at the respective crossed regions, wherein at the location of the electron emission regions perpendicular to the at least two rows, the opening portion of the focusing electrode comprises a short distance area where one side end of the opening portion of the focusing electrode and a same side end of a corresponding one of the opening portions of the second electrodes are spaced apart from each other with a first gap A, and a long distance area where an opposite side end of the opening portion of the focusing electrode and an opposite side end of the corresponding one of the opening portions of the second electrodes are spaced apart from each other with a second gap B, wherein the aspect ratio T/B of the long distance area is ½ or less of the aspect ratio T/A of the short distance area, and wherein T indicates the thickness of the additional insulating layer.

In one embodiment, the first electrodes are cathode electrodes and the second electrodes are gate electrodes.

According to another embodiment of the present invention, an electron emission display includes an electron emission device having a first substrate, a plurality of first electrodes formed on the first substrate, a plurality of electron emission regions electrically connected to the first electrodes, and a plurality of second electrodes positioned with the first electrodes with an insulating layer interposed between the first electrodes and the second electrodes, the second electrodes crossing the first electrodes to form a plurality of crossed regions, wherein at least two rows of the electron emission regions are placed at respective crossed regions along a longitudinal direction of the first electrodes, and the electron emission regions at the respective rows are deviated from each other in a longitudinal direction of the second electrodes, and wherein the insulating layer and the second electrodes have a plurality of opening portions corresponding to the respective electron emission regions to expose the electron emission regions. In addition, the electron emission display includes a second substrate facing the first substrate; three colored phosphor layers formed on a surface of the second substrate; and an anode electrode formed on a surface of the phosphor layers, wherein the phosphor layers are arranged at the respective crossed regions such that a one-colored phosphor layer of the phosphor layers corresponds to each of the crossed regions.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
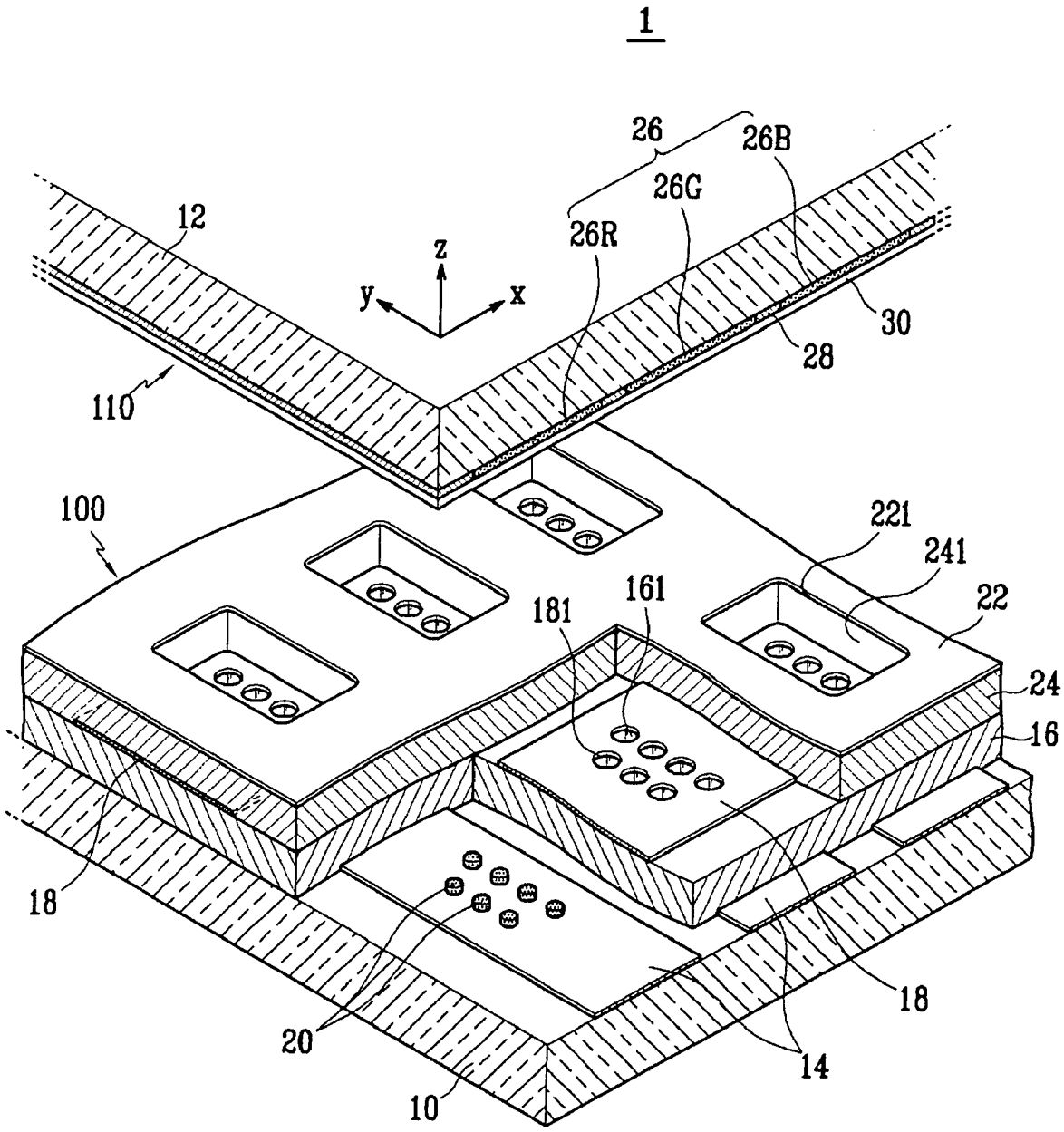
FIG. 1 is a partial exploded perspective view of an electron emission display according to an embodiment of the present invention.
Figure 2:
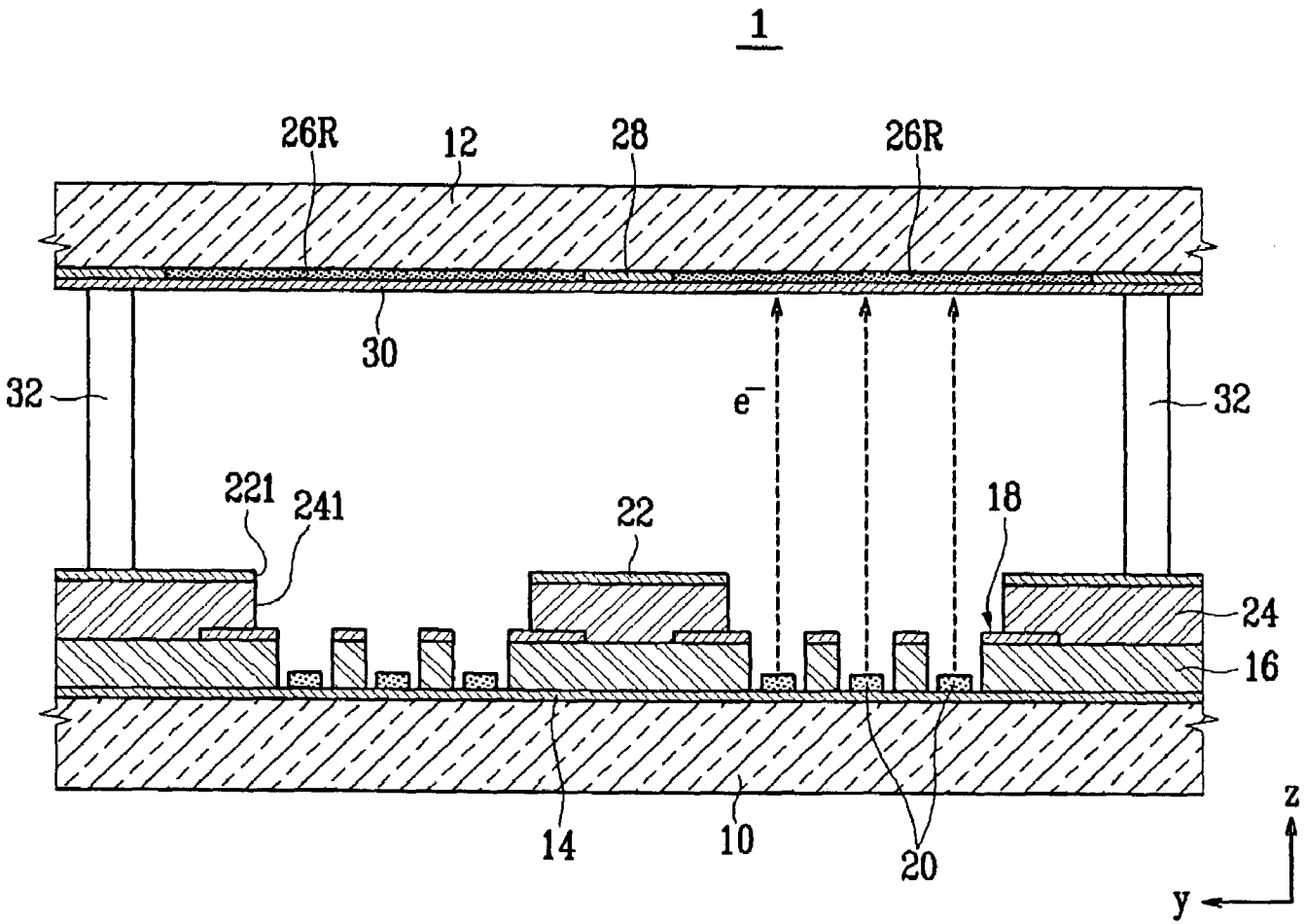
FIG. 2 is a partial sectional view of the electron emission display shown in FIG. 1.
Figure 3:
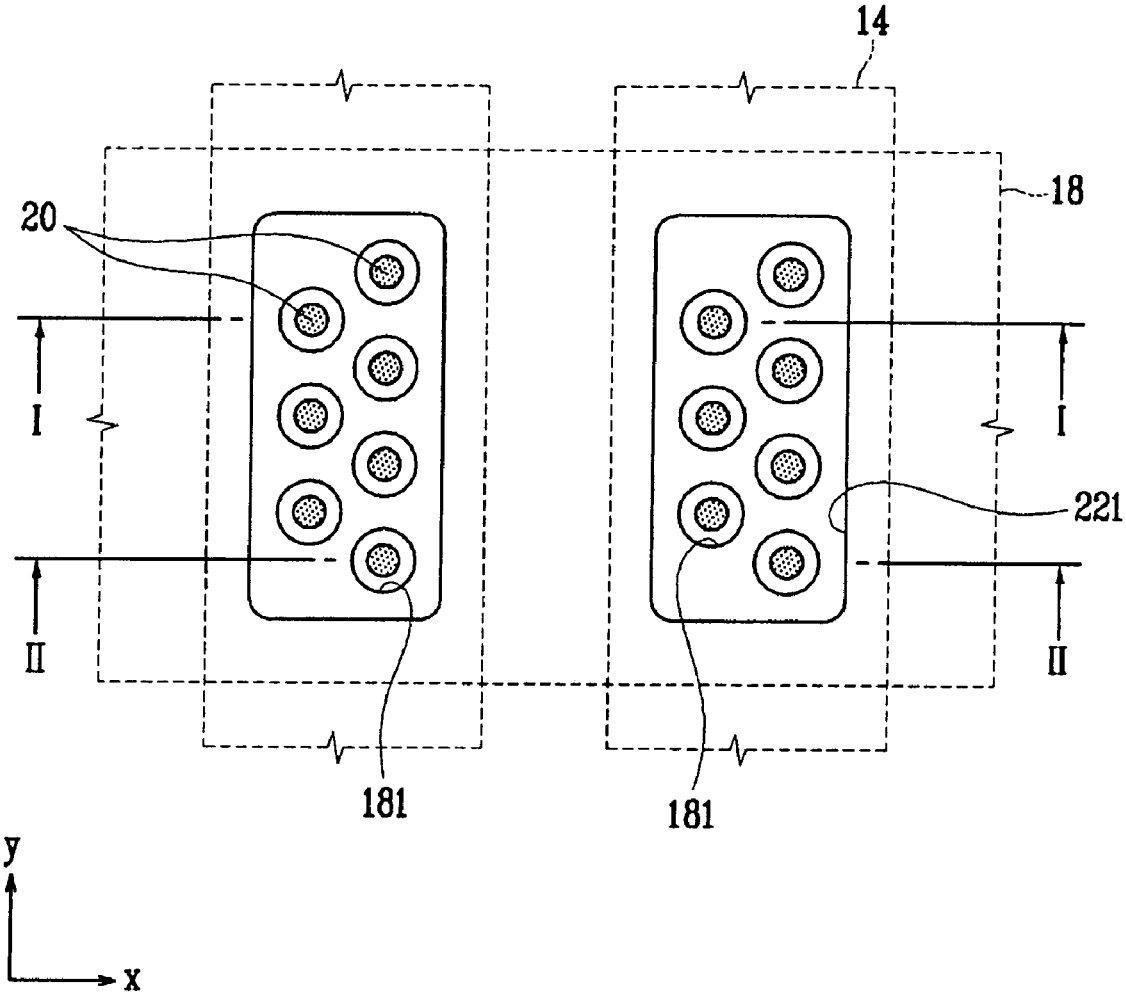
FIG. 3 is a partial plan view of an electron emission device shown in FIG. 1.

FIGS. 1 and 2 are a partial exploded perspective view and a partial sectional view of an electron emission display 1 according to an embodiment of the present invention, and FIG. 3 is a partial plan view of an electron emission device 100 shown in FIG. 1.

As shown in the drawings, the electron emission display 1 includes first and second substrates 10 and 12 facing each other in parallel with a distance therebetween (wherein the distance therebetween may be predetermined). The first and second substrates 10 and 12 are sealed with each other at the peripheries thereof by way of a sealing member (not shown) to form a vessel, and the internal space of the vessel is evacuated to be in a vacuum state (or degree) of about $10^{-6}$ Torr, thereby constructing a vacuum vessel (or chamber).

Arrays of electron emission elements are arranged on a surface of the first substrate 10 facing the second substrate 12 to form the electron emission device 100 together with the first substrate 10. The electron emission device 100 forms the electron emission display 1 together with the second substrate 12. Here, a light emission unit 110 is provided on the second substrate 12.

Cathode electrodes 14, referred to as the first electrodes, are stripe-patterned on the first substrate 10 along a first direction thereof (in a y-axis direction of the drawings), and a first insulating layer 16 is formed on the entire surface area of the first substrate 10 such that it covers the cathode electrodes 14. Gate electrodes 18, referred to as the second electrodes, are stripe-patterned on the first insulating layer 16 perpendicular to the cathode electrodes 14 (in an x-axis direction of the drawings).

Unit pixels are respectively formed at the crossed regions of the cathode and gate electrodes 14 and 18. A plurality of electron emission regions 20 are formed on the cathode electrode 14 for the respective unit pixels. Opening portions 161 and 181 are formed at the first insulating layer 16 and the gate electrode 18 corresponding to the respective electron emission regions 20 to expose the electron emission regions 20 on the first substrate 10.

The electron emission regions 20 are formed with a material that emits electrons when an electric field is applied thereto under a vacuum atmosphere (or state), such as a carbonaceous material and/or a nanometer (nm)-size material. The electron emission regions 20 are formed with CNT, graphite, graphite nanofiber, DLC, $C_{60}$, silicon nanowire, or combinations thereof by way of screen printing, direct growth, sputtering, and/or chemical vapor deposition (CVD).

In this embodiment, at least two rows of the electron emission regions 20 are arranged for (or at) the respective unit pixels along the longitudinal direction of the cathode electrode 14, and the electron emission regions 20 at the respective rows are deviated (or shifted) from each other in the longitudinal direction of the gate electrode 18. Opening portions 161 and 181 are also formed at the first insulating layer 16 and the gate electrodes 18 corresponding to the arrangement of the electron emission regions 20, respectively.

It is illustrated in the drawings that two rows of electron emission regions 20 are arranged along the longitudinal direction of the cathode electrode 14, and the electron emission regions 20 at the respective rows are deviated from each other in the longitudinal direction of the gate electrode 18. That is, the electron emission regions 20 are arranged in a zigzag shape. One of the electron emission regions 20 placed at one row may be positioned corresponding to the center between two of the electron emission regions 20 placed at the other row in the longitudinal direction of the gate electrode 18.

With such an arrangement of the electron emission regions 20 and the gate electrode opening portions 181, the integration of the electron emission regions 20 for the respective unit pixels can be increased (to thereby increase the number of the electron emission regions) without incurring any intolerable deformations, such as the reduction in size of the gate electrode opening portions 181 or the shortening of the distance between the gate electrode opening portions 181, thereby serving to effectively increase the number of electron emission regions 20.

A focusing electrode 22, referred to as the third electrode, is formed on the gate electrodes 18 and first insulating layer 16. A second insulating layer 24 is placed under the focusing electrode 22 to insulate the gate and focusing electrodes 18 and 22 from each other. Opening portions 221 and 241 are formed at the focusing electrode 22 and second insulating layer 24 to pass the electron beams.

In this embodiment, the opening portions 241 and 221 are formed at the second insulating layer 24 and focusing electrode 22 for the respective unit pixels on a one to one basis such that each opening portion exposes all the gate electrode opening portions 181 for one respective unit pixel. In this way, the focusing electrode 22 collectively focuses the electrons emitted for the one respective unit pixel.

The opening portion 221 of the focusing electrode 22 proceeding along the longitudinal direction of the gate electrode 18 is established to be larger in width than a conventional opening portion, due to the arrangement structure of the electron emission regions 20 and the gate electrode opening portions 181. The focusing efficiency of the focusing electrode 22 is enhanced through the optimization structure explained in more detail below.

Figure 4A:
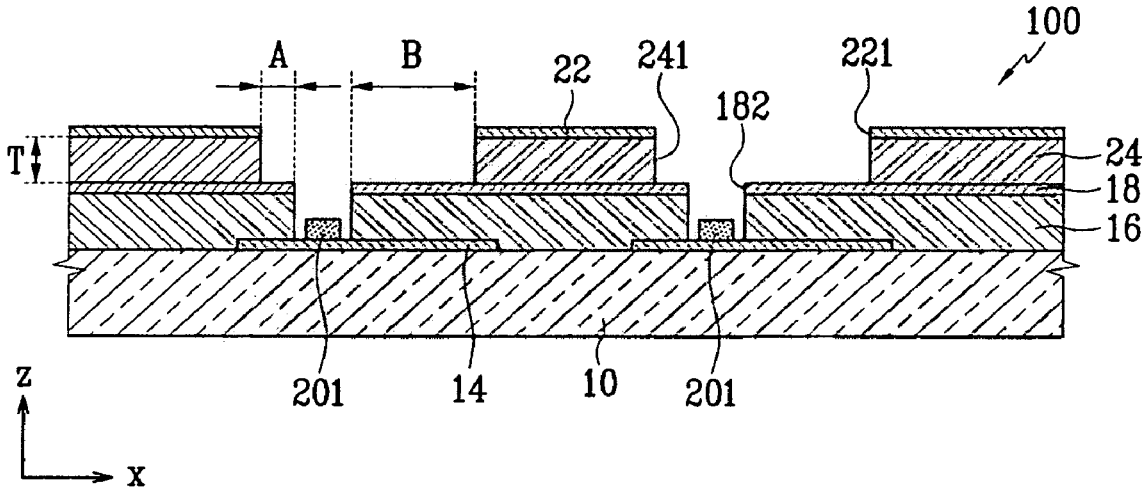
FIG. 4A is a partial sectional view of the electron emission device taken along the I-I line of FIG. 3.
Figure 4B:
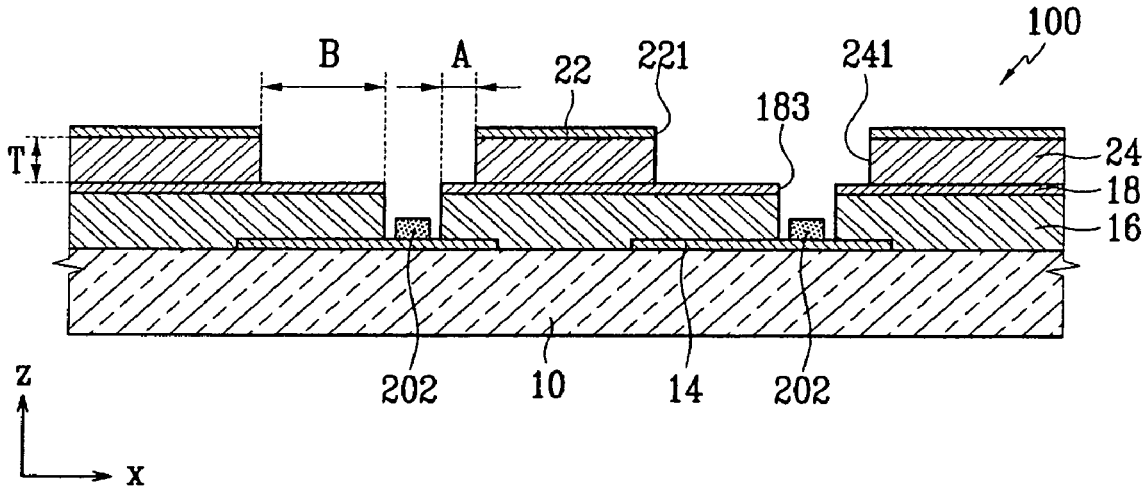
FIG. 4B is a partial sectional view of the electron emission device taken along the II-II line of FIG. 3.

FIGS. 4A and 4B are partial sectional views of the electron emission device taken along the I-I and II-II lines of FIG. 3, respectively.

As shown in FIG. 4A, the electron emission region 201 located at the left side row, based on the drawings, and the opening portion 182 of the gate electrode 18 exposing it are biased to the left side within the opening portion 221 of the focusing electrode 22. With the opening portion 221 of the focusing electrode 22, the one side end thereof is spaced apart from the same side end of the opening portion 182 of the gate electrode 18 at the left side of the electron emission region 20 along the second direction (or surface direction) of the first substrate 10 (in the x-axis direction of the drawings) with a first gap A, and the opposite side end thereof at the right side of the electron emission region 20 is spaced apart from the opposite side end of the opening portion 182 of the gate electrode 18 with a second gap B that is larger than the first gap A.

As shown in FIG. 4B, the electron emission region 202 located at the right side row, based on the drawings, and the opening portion 183 of the gate electrode 18 exposing it are biased to the right side within the opening portion 221 of the focusing electrode 22. With the opening portion 221 of the focusing electrode 22, the one side end thereof is spaced apart from the same side end of the opening portion 183 of the gate electrode 18 at the right side of the electron emission region 202 along the second direction (or surface direction) of the first substrate 10 (in the x-axis direction of the drawings) with a first gap A, and the opposite side end thereof at the left side of the electron emission region 202 is spaced apart from the opposite side end of the opening portion 183 of the gate electrode 18 with a second gap B that is larger than the first gap A.

When the electron emission device 100 is viewed vertically taken along the x-axis direction, the opening portion 221 of the focusing electrode 22 is demarcated into a short distance area where the one side end of the opening portion 221 of the focusing electrode 22 and the same side end of the opening portions 182 and 183 of the gate electrode 18 are spaced apart from each other with a first gap A, and a long distance area where the opposite side end of the opening portion 221 of the focusing electrode 22 and the opposite side end of the opening portions 182 and 183 of the gate electrode 18 are spaced apart from each other with a second gap B. The aspect ratio T/B of the long distance area is established to be ½ or less of the aspect ratio T/A of the short distance area. The value of T indicates the thickness of the second insulating layer 24, which is the distance between the gate and the focusing electrodes 18 and 22 along a third direction (or thickness direction) of the first substrate 10 (in a z-axis direction of the drawings).

The focusing electrode 22 satisfying the above condition exerts the effects of increasing the electron beam focusing efficiency with respect to the electron emission regions 20 placed at the long distance area, and inhibiting over-focusing due to the focusing electrode 22 with respect to the electron emission regions 20 placed at the short distance area to thereby reduce or prevent the emitted electrons from being intercepted by the focusing electric field.

Referring back to FIGS. 1 and 2, phosphor layers 26 with red, green, and blue phosphor layers 26R, 26G, and 26B are formed on a surface of the second substrate 12 facing the first substrate 10 such that they are spaced apart from each other by a distance, and black layers 28 are disposed between the respective phosphor layers 26 to enhance the screen contrast. The phosphor layers 26 are arranged for the respective pixels (or sub-pixels) defined on the first substrate 10 on a one to one basis.

An anode electrode 30 is formed on the phosphor and the black layers 26 and 28 with a metallic material, such as aluminum (Al). The anode electrode 30 receives a high voltage required for accelerating the electron beams from an external source to cause the phosphor layers 26 to be in a high potential state, and reflects the visible lights radiated from the phosphor layers 26 to the first substrate 10 toward the second substrate 12, thereby increasing the screen luminance.

Alternatively, the anode electrode may be formed with a transparent conductive material such as indium tin oxide (ITO), instead of the metallic material. In this case, the anode electrode is placed on a surface of the phosphor and black layers 26 and 28 between the second substrate 12 and the surface of the phosphor and black layers 26 and 28. Furthermore, it is also possible to simultaneously use a transparent conductive layer and a metallic layer as the anode electrode.

As shown in FIG. 2, a plurality of spacers 32 are arranged between the first and second substrates 10 and 12 to endure the pressure applied to the vacuum vessel and to constantly maintain (or sustain) the distance between the two substrates 10 and 12. The spacers 32 are placed at the area of the black layer 28 such that they do not intrude upon the area of the phosphor layers 26.

The above-structured electron emission display is driven by applying voltages (which may be predetermined) to the cathode electrodes 14, the gate electrodes 18, the focusing electrode 22, and the anode electrode 30 from one or more external sources.

For instance, when the cathode electrodes 14 receive scan driving voltages to function as the scan electrodes, the gate electrodes 18 receive data driving voltages to function as the data electrodes (or vise versa). The focusing electrode 22 receives a voltage required for focusing electron beams, for instance, 0V or a negative direct current voltage ranging from several to several tens of volts. The anode electrode 30 receives a voltage required for accelerating the electron beams, for instance, a positive direct current voltage ranging from several hundreds to several thousands of volts.

Then, electric fields are formed around the electron emission regions 20 at the pixels where the voltage difference between the cathode and gate electrodes 14 and 18 exceeds the threshold value, and electrons are emitted from the electron emission regions 20 due to the electric fields. The emitted electrons are centrally focused into a bundle of electron beams while passing the opening portion 221 of the focusing electrode 22. The focused electron beams are then attracted by the high voltage applied to the anode electrode 30, and collide against the phosphor layers 26 at the relevant pixels, thereby exciting them to emit light.

With the driving process of the electron emission display according to the present embodiment, the electron emission regions 20 and the gate electrode opening portions 181 are arranged with high integration so that the number of electron emission regions 20 for the respective unit pixels increases, thereby increasing the electron emission uniformity and lowering the driving voltage. Furthermore, with the electron emission display according to the present embodiment, the focusing efficiency of the focusing electrode 22 is enhanced due to the shape of the opening portion 221 thereof, thereby reducing or preventing the display quality from being deteriorated with the incorrect color light emissions.

As described above, with an electron emission display according to an embodiment the present invention, the number of electron emission regions for the respective unit pixels is increased to thereby increase the electron emission uniformity, lower the driving voltage, and increase the amount of electrons emitted from the electron emission regions, thereby realizing a high-luminance display screen. Furthermore, with an electron emission device according to an embodiment of the present invention, the electron beam focusing efficiency is enhanced to reduce or prevent the incorrect color light emission, thereby realizing a high-quality display screen.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a substrate;

a plurality of first electrodes on the substrate;

a plurality of electron emission regions electrically connected to the first electrodes;

a plurality of second electrodes over the first electrodes with an insulating layer interposed between the first electrodes and the second electrodes, the second electrodes crossing the first electrodes to form a plurality of crossing regions; and a focusing electrode over the second electrodes with an additional insulating layer interposed between the second electrodes and the focusing electrode, wherein at least two rows of the electron emission regions are arranged at respective crossing regions along a longitudinal direction of the first electrodes, and the electron emission regions at the respective rows are deviated from each other in a longitudinal direction of the second electrodes, wherein the insulating layer and the second electrodes have a plurality of opening portions corresponding to the respective electron emission regions to expose the electron emission regions, wherein the additional insulating layer and the focusing electrode have one opening portion at each of the crossing regions for exposing the at least two rows of the electron emission regions arranged at the corresponding crossing regions, wherein, at the location of the electron emission regions perpendicular to the at least two rows, the opening portion of the focusing electrode comprises a short distance where a first side end of the opening portion of the focusing electrode and a first side end of a corresponding one of the opening portions of the second electrodes are spaced apart from each other with a first gap A, and a long distance where a second side end of the opening portion of the focusing electrode opposite the first side end of the opening portion of the first electrode and a second side end of the corresponding one of the opening portions of the second electrodes are spaced apart from each other with a second gap B, wherein the long distance of the second gap B is not less than twice the short distance of the first gap A.

2. The electron emission device of claim 1, wherein one of the electron emission regions of one of the at least two rows of the electron emission regions is positioned to correspond to the center between two of the electron emission regions of another one of the at least two rows of the electron emission regions.

3. The electron emission device of claim 1, wherein the at least two rows of the electron emission regions are arranged for the respective crossing regions in a zigzag shape.

4. The electron emission device of claim 1, wherein the electron emission regions comprise at least one material selected from the group consisting of carbon nanotubes, graphite, graphite nanofiber, diamond, diamond-like carbon, $C_{60}$, silicon nanowire, and combinations thereof.

5. The electron emission device of claim 1, wherein the aspect ratio T/B corresponding to the long distance is ½ or less of the aspect ratio T/A corresponding to the short distance, and wherein T indicates the thickness of the additional insulating layer.

6. The electron emission device of claim 1, wherein the first electrodes are cathode electrodes and the second electrodes are gate electrodes.

7. An electron emission display device comprising:

an electron emission device comprising a first substrate, a plurality of first electrodes on the first substrate, a plurality of electron emission regions electrically connected to the first electrodes, a plurality of second electrodes over the first electrodes with an insulating layer interposed between the first electrodes and the second electrodes, the second electrodes crossing the first electrodes to form a plurality of crossing regions, and a focusing electrode over the second electrodes with an additional insulating layer interposed between the second electrodes and the focusing electrode, wherein at least two rows of the electron emission regions are arranged at respective crossing regions along a longitudinal direction of the first electrodes, and the electron emission regions at the respective rows are deviated from each other in a longitudinal direction of the second electrodes, wherein the insulating layer and the second electrodes have a plurality of opening portions corresponding to the respective electron emission regions to expose the electron emission regions, wherein the additional insulating layer and the focusing electrode have one opening portion at each of the crossing regions for exposing the at least two rows of the electron emission regions arranged at the corresponding crossing regions, wherein, at the location of the electron emission regions perpendicular to the at least two rows, the opening portion of the focusing electrode comprises a short distance where a first side end of the opening portion of the focusing electrode and a first side end of a corresponding one of the opening portions of the second electrodes are spaced apart from each other with a first gap A, and a long distance where a second side end of the opening portion of the focusing electrode opposite the first side end of the opening portion of the first electrode and a second side end of the corresponding one of the opening portions of the second electrodes are spaced apart from each other with a second gap B, wherein the long distance of the second gap B is not less than twice the short distance of the first gap A; and a second substrate facing the first substrate;

three colored phosphor layers formed on a surface of the second substrate; and an anode electrode formed on a surface of the phosphor layers, wherein the phosphor layers are arranged at the respective crossing regions such that a one-colored phosphor layer of the phosphor layers corresponds to each of the crossing regions.

8. The electron emission display device of claim 7, wherein one of the electron emission regions of one of the at least two rows of the electron emission regions is positioned to correspond to the center between two of the electron emission regions of another one of the at least two rows of the electron emission regions.

9. The electron emission display device of claim 7, wherein the at least two rows of the electron emission regions are arranged for the respective crossing regions in a zigzag shape.

10. The electron emission display device of claim 7, wherein the electron emission regions comprise at least one material selected from the group consisting of carbon nanotubes, graphite, graphite nanofiber, diamond, diamond-like carbon, $C_{60}$, silicon nanowire, and combinations thereof.

11. The electron emission display device of claim 7, wherein the aspect ratio T/B corresponding to the long distance is ½ or less of the aspect ratio T/A corresponding to the short distance, and wherein T indicates the thickness of the additional insulating layer.

12. The electron emission display device of claim 7, wherein the first electrodes are cathode electrodes and the second electrodes are gate electrodes.

* * * * *